United States Patent [19]

Hynes

[11] 4,322,075

[45] Mar. 30, 1982

[54] BATTING PRACTICE DEVICE

[76] Inventor: William T. Hynes, 2824 Hogan Ct., Falls Church, Va. 22043

[21] Appl. No.: 188,797

[22] Filed: Sep. 19, 1980

[51] Int. Cl.[3] ..... A63B 69/40

[52] U.S. Cl. ..... 273/26 E

[58] Field of Search ..... 273/26 E, 29 A, 185 C, 273/196, 200 R; 272/76, 77, 78

[56] References Cited

U.S. PATENT DOCUMENTS

| | | | |
|---|---|---|---|
| 712,000 | 10/1902 | McFadden | 272/78 |
| 2,247,072 | 6/1941 | Stow | 273/29 A |
| 3,143,351 | 8/1964 | Bertrand | 273/200 R |
| 3,475,026 | 10/1969 | Cooper | 273/26 E |
| 3,825,259 | 7/1974 | Burchett | 273/26 E |

FOREIGN PATENT DOCUMENTS

| | | | |
|---|---|---|---|
| 374404 | 4/1923 | Fed. Rep. of Germany | 273/26 E |

*Primary Examiner*—Richard C. Pinkham
*Assistant Examiner*—T. Brown
*Attorney, Agent, or Firm*—Henderson & Sturm

[57] ABSTRACT

A batting practice device has a rigidly secured vertical support having a normally disposed horizontal support. A ball is suspended from the horizontal support by a first tether and is secured to the vertical support by a second tether. The device includes a mechanism for adjusting the height of the ball above ground.

12 Claims, 2 Drawing Figures

BATTING PRACTICE DEVICE

BACKGROUND OF THE INVENTION

The present invention relates to the field of athletic equipment, and more particularly, to batting practice devices.

The prior art, shown by U.S. Pat. Nos. 3,397,885; 3,442,510; 4,138,107; 1,554,409; and 4,050,694, discloses various structures most of which utilize elastic cords attached to a ball which return the ball after it has been hit by a bat, racket or other object. A problem with these types of devices when used for a baseball batting practice is that the impetus applied to the ball is so great that the balls flail about at high speeds endangering the user. U.S. Pat. No. 3,442,510, reflects this problem by the disclosure of protective screens employed there. Another problem with these types of devices is that once the ball has been hit there is a substantial delay before the ball stops bouncing around and assumes a position whereon it can be struck again.

Some prior art structures (U.S. Pat. Nos. 3,397,885, and 4,050,694) avoid this problem by suspending the ball from an elevated support by a nonelastic cord. These structures also have problems, however, in that the cord becomes wound about the horizontal support after the ball has been hit; or if the cord is pivotally connected, the ball spins about the support in a circular motion after being hit. Here again, there is a substantial delay before the ball returns to its normal position or is unwound from the support. In fact, the ball must usually be steadied by hand to stop it from swinging backward and forward and from side to side. In addition, the structures of the prior art are very difficult to adjust to accomodate different height batters.

There is, thus, a need for a batting practice device which avoids the above set forth problems of the prior art.

SUMMARY OF THE INVENTION

The present invention therefore comprises a batting practice device which quickly and safely returns the ball to its normal position after it has been hit, and which permits the height of the ball above the ground to be easily adjusted.

The device has a vertical support rigidly secured in the vertical position and a horizontal support normally disposed therefrom. A ball is suspended from the horizontal support by a first tether, and a second tether connects the ball to the vertical support. The tethers act together and are of such lengths and so positioned such that the ball cannot be wrapped around the horizontal support after it has been hit, and in addition, is restrained from swinging around the vertical support so that it quickly resumes a position whereat it can again be struck.

The invention also includes a mechanism for easily adjusting the height of the ball above the ground to accomodate different size batters.

It is therefore an object of the present invention to provide an improved batting practice device.

Another object of the present invention is to provide a batting practice device which prevents the ball from traveling over the horizontal support.

A further object of the present invention is to provide a device which restrains the swinging of the ball after it has been hit to more quickly allow it to resume its normal position where it can be hit again.

Yet another object of the present invention is to provide an apparatus which includes a mechanism for easily adjusting the height of the ball above the ground for different size batters.

These and other objects, advantages and novel features of the invention will become apparent from the following detailed description of the invention taken in conjunction with the accompanying drawings.

DESCRIPTION OF THE PREFERRED EMBODIMENT

Figure 1:
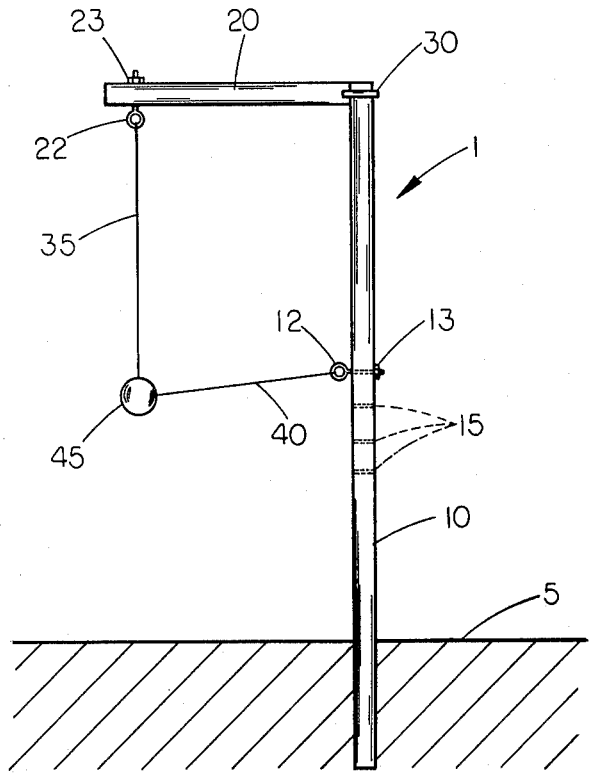
FIG. 1 shows a first embodiment of the present invention.

The batting practice device depicted generally as 1, shown in FIG. 1 has a vertical support 10 which is rigidly held in the vertical position by any suitable means. Here, the support 10 is embedded in the ground 5, or in a concrete footing (not shown), to a sufficient depth to provide rigid securement. Of course, other means such as securement to a base member such as is shown in U.S. Pat. No. 4,050,694 would also be suitable.

A horizontal support 20 is normally disposed from the upper end of vertical support 10 as shown. A suitable clamp 30, rigidly secures the support 20 to support 10. The clamp 30 is releasable to secure the horizontal support 20 at any position along the vertical support 10. Of course, various types of clamps such as C-clamps, for example, could be used to serve this purpose.

The outward end of horizontal support 20 is suitably apertured (not shown) to accomodate a first eye bolt 22 which is secured to support 20 by a threadably engaged first nut 23. A first tether 35 of a length which is somewhat greater than the distance eye bolt 22 is from the intersection of support 20 and support 10 is secured at its upper end to first eye bolt 22 and at its lower end to a ball 45 by any suitable means. U.S. Pat. No. 3,442,510, which is hereby incorporated by reference, discloses such a ball secured to a tether. Ball 45 can be a baseball, softball or any other suitable ball.

Vertical post 10 is likewise suitably apertured to accomodate a second eye bolt 12 which is secured to the support 10, by a threadably engaged second nut 13, at a point which is a distance below the intersection of support 20 and support 10 which is greater than the distance eye bolt 22 is from said intersection and approximately equal to the length of first tether 35. A second tether 40 is secured at one end to second eye bolt 12 and at the other end to the ball 45 in any suitable manner such that tether 40 has substantially no sag when ball 45 is hanging vertically. Vertical support 10 also includes a plurality of vertically arranged apertures 15 which serve a purpose which will become apparent.

Having thus described the structure of a first embodiment of the present invention, it operates as follows:

The batting practice device 1, suspends the ball 45 above the ground at a suitable height for a user (not shown) to strike the ball 45 with a baseball bat, for example, and thus, practice batting. Once the ball 45 is hit, it moves in the direction of the impetus, but is restrained by the tethers 35, 40 secured to the supports 20, 10 respectively. Consequently, the ball will tend to wrap the tethers 35, 40 about the support 10, but due to the construction of the device 1, it will normally automatically unwrap the tethers 35, 40 and return to its normal position so that the batter can readily strike it again. Note that in the unlikely event that the tethers 35, 40 don't automatically become unwrapped, they can very easily be manually assisted in doing so. Most importantly ball 45 cannot travel over support 20, nor as a consequence wrap around it, because of the above described limitations on the position of eye bolt 12 and the lengths of tethers 35 and 40. Also, the second tether 40, in particular, assists in preventing the sideways swaying of the ball so that it quickly resumes its normal position.

The present structure, in addition, is adjustable to accomodate any height batter by adjusting the height of the ball above the ground. To adjust the device 1, the clamp 30 is loosened to reposition the horizontal support 20 along the vertical support 10, and the position of the second tether 40 is correspondingly changed. For example, to accomodate a shorter batter, the support 20 would be clamped at a lower position on the support 10 and the second eye bolt 12 would be moved approximately the same distance down the vertical support 10 by insertion and resecurement into one of the vertically arranged apertures 15. In this way, the orientation of the tethers 35, 40 with respect to each other remains substantially unchanged, with only the height of the ball 45 above the ground 5 being raised.

Figure 2:
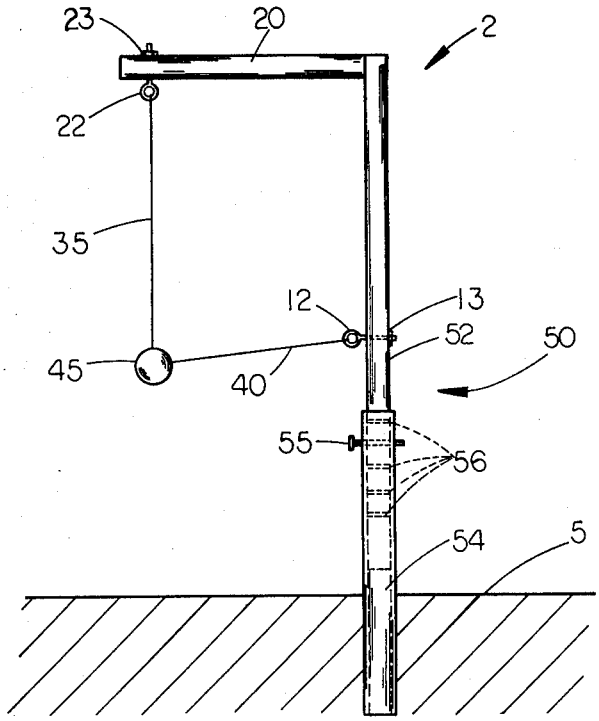
FIG. 2 shows a second embodiment of the present invention.

FIG. 2 shows a second embodiment 2 of the present invention. This embodiment 2 is constructed in the same manner as the first embodiment 1 except as follows:

In the second embodiment 2, horizontal support 20 is permanently secured to the vertical support 50, such as by welding, rather than being adjustably secured by the clamp 30.

Second, vertical support 50 is a telescoping structure having a lower member 54, an upper member 52, and an adjustment pin 55. Lower member 54 has its lower portion embedded below the ground 5 for rigid securement in the vertical position. Lower member 54 receives upper member 52 in a telescoping relationship such that the member 52 can slide up and down within the member 54. Upper member 54 includes a plurality of vertically arranged apertures 56. A pin 55 which is received within suitable apertures (not shown) in lower member 54, is insertable within any of the apertures 56 to vary the overall height of the vertical support 50. Note that this structure permits the height of the ball 45 to be varied without disturbing the portion of the apparatus 2 which secures (and includes) the tethers 35,40 and ball 45. The second embodiment 2, in all other respects not mentioned, operates and is constructed identically to the first embodiment 1.

Having thus disclosed the present invention, variations and modifications thereof would be obvious to one skilled in the art. It is therefore intended to be understood that the invention is only to be limited by the scope of the appended claims.

I claim:

1. A batting practice device comprising:

(a) a single vertical support rigidly secured in a substantially vertical position;

(b) a horizontal support secured at one of its ends to the upper end of said vertical support;

(c) a first non-elastic tether having one of its ends attached to the other end of said horizontal support;

(d) a second non-elastic tether having one of its ends attached intermediate the ends of said vertical support, said first tether being of such a length and secured at a point on said horizontal support such that its length added to the length of the second tether will be substantially greater than the distance between the point at which the first tether is secured to the horizontal support and the point at which the second tether is secured to the vertical support; and (e) a ball secured to the other end of each of said first tether and said second tether such that said ball is suspended from said apparatus above the ground.

2. The batting practice device of claim 1, further comprising a means for adjusting the height of said ball above the ground.

3. The batting practice device of claim 2, wherein said ball height adjustment means comprises a means for adjusting the height of said vertical support.

4. The batting practice device of claim 3, wherein said vertical support includes a plurality of telescoping members, and said vertical support height adjustment means comprises said telescoping members.

5. The batting practice device of claim 2 wherein said ball height adjustment means includes a means for adjusting the position of said horizontal support by releasably clamping it along the length of said vertical support, and a means for correspondingly adjusting the position at which said second tether is secured along said vertical support.

6. The batting practice device of claim 1 wherein said first tether and said second tether are of such lengths and are connected to the supports at such positions that the ball cannot travel over said horizontal support.

7. The batting practice device of claim 6 wherein said second tether is of such length that it has substantially no sag when the first tether hangs substantially vertically.

8. The batting practice device of claim 6 wherein said second tether is secured along said vertical support at a position which is below said horizontal support a distance greater than the length of said second tether and which is above said ball so that said second tether is inclined upwardly.

9. The batting practice device of claim 6, further comprising a means for adjusting the height of said ball above the ground.

10. The batting practice device of claim 9, wherein said ball height adjustment means comprises a means for adjusting the height of said vertical support.

11. The batting practice device of claim 10 wherein said vertical support includes a plurality of telescoping members, and said vertical support height adjustment means comprises said telescoping members.

12. The batting practice device of claim 6 wherein said ball height adjustment means includes a means for adjusting the position of said horizontal support by releasably clamping it along the length of said vertical support, and a means for correspondingly adjusting the position at which said second tether is secured along said vertical support.

* * * * *